US010916230B2

(12) United States Patent
Yamamoto

(10) Patent No.: US 10,916,230 B2
(45) Date of Patent: Feb. 9, 2021

(54) SENSOR AND KEYBOARD DEVICE

(71) Applicant: YAMAHA CORPORATION, Hamamatsu (JP)

(72) Inventor: Shin Yamamoto, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/577,157

(22) Filed: Sep. 20, 2019

(65) Prior Publication Data

US 2020/0013381 A1 Jan. 9, 2020

Related U.S. Application Data

(63) Continuation of application No. PCT/JP2018/007481, filed on Feb. 28, 2018.

(30) Foreign Application Priority Data

Mar. 24, 2017 (JP) ..... 2017-060169

(51) Int. Cl.
*G10H 1/34* (2006.01)
*G10B 3/12* (2006.01)

(52) U.S. Cl.
CPC ..... *G10H 1/346* (2013.01); *G10B 3/12* (2013.01)

(58) Field of Classification Search
CPC ..... G10H 1/34; G10H 2220/561; G10H 3/00; G10H 3/181; G10H 1/346; G10C 3/18
See application file for complete search history.

(56) References Cited

U.S. PATENT DOCUMENTS

2007/0017354 A1* 1/2007 Nishida ..... G10H 1/346 84/724
2009/0235810 A1* 9/2009 Yaguchi ..... G10H 1/346 84/626
2020/0005751 A1* 1/2020 Tanoue ..... G10H 1/0558
2020/0013381 A1* 1/2020 Yamamoto ..... G10B 3/12
(Continued)

FOREIGN PATENT DOCUMENTS

JP S5728495 U 2/1982
JP 2001117563 A 4/2001
JP 2004226687 A 8/2004

OTHER PUBLICATIONS

International Search Report issued in Intl. Appln. No. PCT/JP2018/007481 dated May 15, 2018.
(Continued)

*Primary Examiner* — Marlon T Fletcher
(74) *Attorney, Agent, or Firm* — Rossi, Kimms & McDowell LLP

(57) ABSTRACT

A sensor includes: an upper electrode; a lower electrode provided facing the upper electrode; an upper electrode support portion provided in an upper portion of the upper electrode; a deforming portion provided at both ends of the upper electrode support portion and enabling a distance between the upper electrode and the lower electrode to be changed; a rotatable actuator arranged facing the upper electrode support portion; and a member arranged between the upper electrode support portion and the actuator, and capable of moving relative to at least one of the actuator and the upper electrode support portion when the actuator presses the upper electrode support portion.

12 Claims, 10 Drawing Sheets

(56) References Cited

U.S. PATENT DOCUMENTS

| | | | | |
|---|---|---|---|---|
| 2020/0027432 | A1* | 1/2020 | Yamamoto | G10H 1/346 |
| 2020/0043452 | A1* | 2/2020 | Yamamoto | G10H 1/18 |

OTHER PUBLICATIONS

Written Opinion issued in Intl. Appln. No. PCT/JP2018/007481 dated May 15, 2018.
Office Action issued in Japanese Appln. No. 2017-060169 dated Dec. 8, 2020. English machine translation provided.

* cited by examiner (A)

(B)

SENSOR AND KEYBOARD DEVICE

TECHNICAL FIELD

The present invention relates to a sensor and a keyboard device.

BACKGROUND ART

In an acoustic piano, an action mechanism operates to convey a predetermined feeling (hereinafter referred to as a touch feeling) to a player's finger through a key. In the acoustic piano, the action mechanism is required to press a key with a hammer. On the other hand, in an electronic keyboard musical instrument, key pressing is detected by a sensor, so it is possible to generate sound without having an action mechanism like that in an acoustic piano. The touch feeling of an electronic keyboard musical instrument that does not use an action mechanism, or an electronic keyboard musical instrument that uses a simple action mechanism, feels very different from the touch feeling of an acoustic piano. Therefore, technology has been disclosed in which, in an electronic keyboard musical instrument, a mechanism corresponding to a hammer in an acoustic piano is provided in order to obtain a touch feeling that is even slightly close to the touch feeling of an acoustic piano (for example, see Patent Literature 1).

Patent Literature 1: JP 2004-226687A

SUMMARY OF INVENTION

In the above technology, sound is generated by the hammer moving according to a key pressing operation by the player to press the sensor. In this case, it is sufficient that force is always applied in the direction perpendicular to the key, but in a case where the key is far away from the player, or when the key is strongly pressed, force is not necessarily applied only in the perpendicular direction, and in some cases the application of force is shifted in a scale direction (a lateral direction) in which keys are arranged. In such a case, the sensor does not operate stably, and there is a risk that a sound generation defect may occur.

One object of the present invention is to enable stable generation of sound when a player presses a key in an electronic musical instrument.

According to the present invention, there is provided a sensor that includes: an upper electrode; a lower electrode provided facing the upper electrode; an upper electrode support portion provided in an upper portion of the upper electrode; a deforming portion provided at both ends of the upper electrode support portion and enabling a distance between the upper electrode and the lower electrode to be changed; a rotatable actuator arranged facing the upper electrode support portion; and a member arranged between the upper electrode support portion and the actuator, and capable of moving relative to at least one of the actuator and the upper electrode support portion when the actuator presses the upper electrode support portion.

In the above-described sensor, a configuration may be adopted in which the lower electrode is arranged on the lower electrode support portion, and the upper electrode and the lower electrode are arranged within an area enclosed by the lower electrode support portion, the upper electrode support portion, and the deforming portion.

In the above-described sensor, the movable member may be arranged in the upper electrode support portion.

In the above-described sensor, the movable member may include a plurality of provided particles.

In the above-described sensor, the movable member may further include a film that holds the particles.

In the above-described sensor, a configuration may be adopted in which at least one of the upper electrode support portion and the actuator includes at least one recessed portion larger than the diameter of the particles, and at least a part of the particles is exposed from the recessed portion.

In the above-described sensor, the movable member may include a lubricant.

In the above-described sensor, a configuration may be adopted in which at least one of the inside and an upper face of the upper electrode support portion and at least one of the inside and a side face of the deforming portion include a permeation inhibitor of the lubricant.

In the above-described sensor, a width of the actuator may be greater than a width of the upper electrode support portion in a direction that the actuator moves relative to the upper electrode support portion.

In the above-described sensor, the width of the actuator may be equal to or less than the width of the upper electrode support portion in the direction that the actuator moves relative to the upper electrode support portion.

According to the present invention, there is provided a keyboard device that includes any sensor described above and a key. Here, the actuator is a hammer that rotates according to rotation of the key.

According to the present invention, there is provided a keyboard device that includes any sensor described above. Here, the actuator is a key.

According to the present invention, there is provided a keyboard device that includes: any sensor described above; a key; and a hammer that rotates according to rotation of the key. Here, the actuator is a movable member that operates together with the key.

According to the present invention, it is possible to stably generate sound when a player presses a key in an electronic musical instrument.

DESCRIPTION OF EMBODIMENTS

Figure 1:
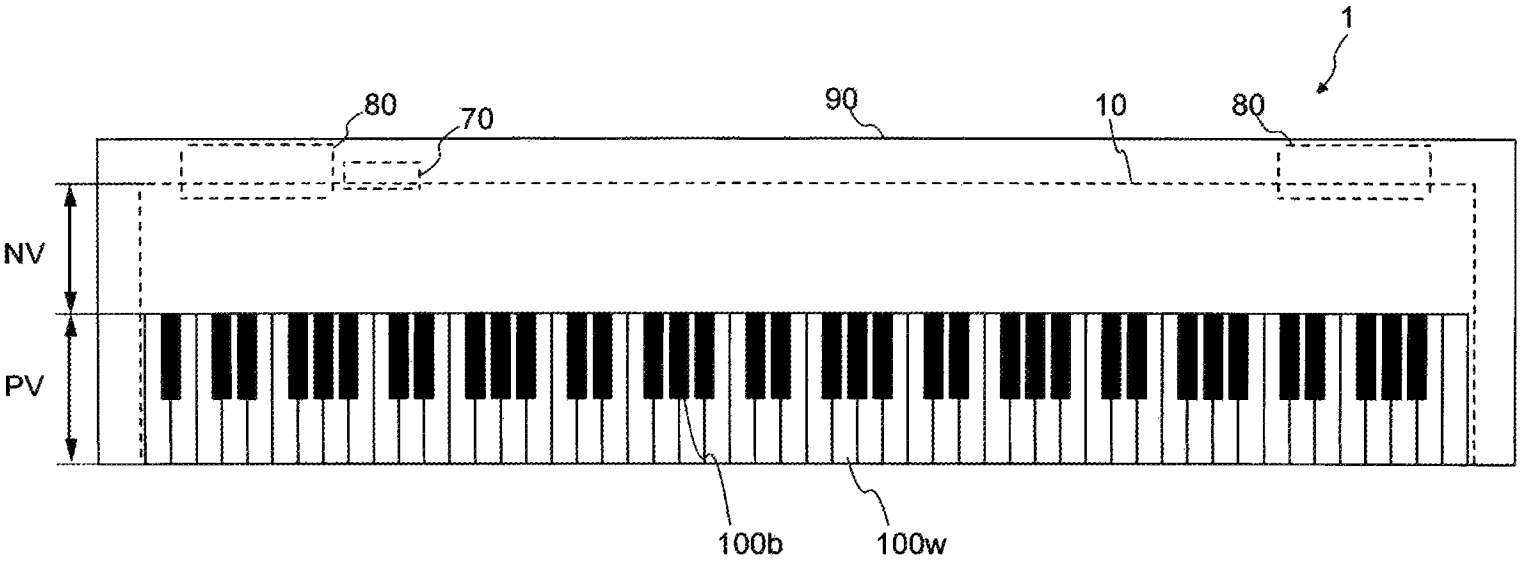
FIG. 1 shows the configuration of a keyboard device in a first embodiment.

Hereinafter, a keyboard device in one embodiment of the present invention will be described in detail with reference to the drawings. The embodiment disclosed below is an example of an embodiment of the present invention, and the present invention is not to be interpreted as limited by this embodiment. In the drawings referred to in the present embodiment, the same portions or portions having similar functions are denoted by the same reference numerals or similar reference numerals (reference numerals with only xxx-1, xxx-2, or the like appended after numerals), and repeated description of such portions may be omitted. Also, dimensional ratios (ratios between configurations, ratios between vertical and horizontal directions, or the like) in the drawings may differ from actual ratios for convenience of a description, and some configurations may be omitted from the drawings.

First Embodiment 1-1. Configuration of Keyboard Device

FIG. 1 shows the configuration of a keyboard device in a first embodiment. In this example, a keyboard device 1 is an electronic keyboard musical instrument such as an electronic piano that generates sound according to key pressing by a user (a player). Note that the keyboard device 1 may also be a keyboard-type controller that outputs control data (for example, MIDI) for controlling an external sound source device according to key pressing. In this case, the keyboard device 1 may not be provided with a sound source device.

The keyboard device 1 includes a keyboard assembly 10. The keyboard assembly 10 includes white keys 100*w* and black keys 100*b*. A plurality of the white keys 100*w* and the black keys 100*b* are arranged side by side. The number of keys 100 is N, which is 88 in this example. The direction in which the keys 100 are arranged is referred to as a scale direction. When the white keys 100*w* and the black keys 100*b* can be described without particularly distinguishing them, they may be referred to as the keys 100. In the following description as well, when "w" is appended to the end of a reference numeral, this means that the configuration corresponds to a white key. Further, when "b" is added to the end of a reference numeral, this means that the configuration corresponds to a black key.

Part of the keyboard assembly 10 exists inside a case 90. When the keyboard device 1 is viewed from above, a portion of the keyboard assembly 10 covered by the case 90 is referred to as a non-visible portion NV, and a portion exposed from the case 90 and visible to the user is referred to as a visible portion PV. That is, the visible portion PV includes part of the keys 100 and indicates an area where the user can perform a musical performance playing operation. Hereinafter, the portion of the keys 100 exposed by the visible portion PV may also be referred to as a key main body.

A sound source device 70 and a speaker 80 are arranged inside of the case 90. The sound source device 70 generates a sound waveform signal according to pressing of a key 100. The speaker 80 outputs the sound waveform signal generated in the sound source device 70 to an external space. Note that the keyboard device 1 may also be provided with a slider for controlling volume, a switch for switching timbre, a display that displays various information, and the like.

Note that in the description of this specification, directions such as up, down, left, right, front and rear indicate directions when the keyboard device 1 is viewed from the player when playing. Therefore, for example, the non-visible portion NV can be said to be located on the rear side relative to the visible portion PV. Also, the direction may be indicated based on the keys 100, such as a key front end side (key front side) and a key rear end side (key rear side). In this case, the key front end side indicates the front side of the keys 100 as viewed from the player. The key rear end side indicates the rear side of the keys 100 as viewed from the player. According to this definition, it can be said that a portion from the front end to the rear end of the key main body of a black key 100*b* is a portion protruding upward from the white keys 100*w*.

Figure 2:
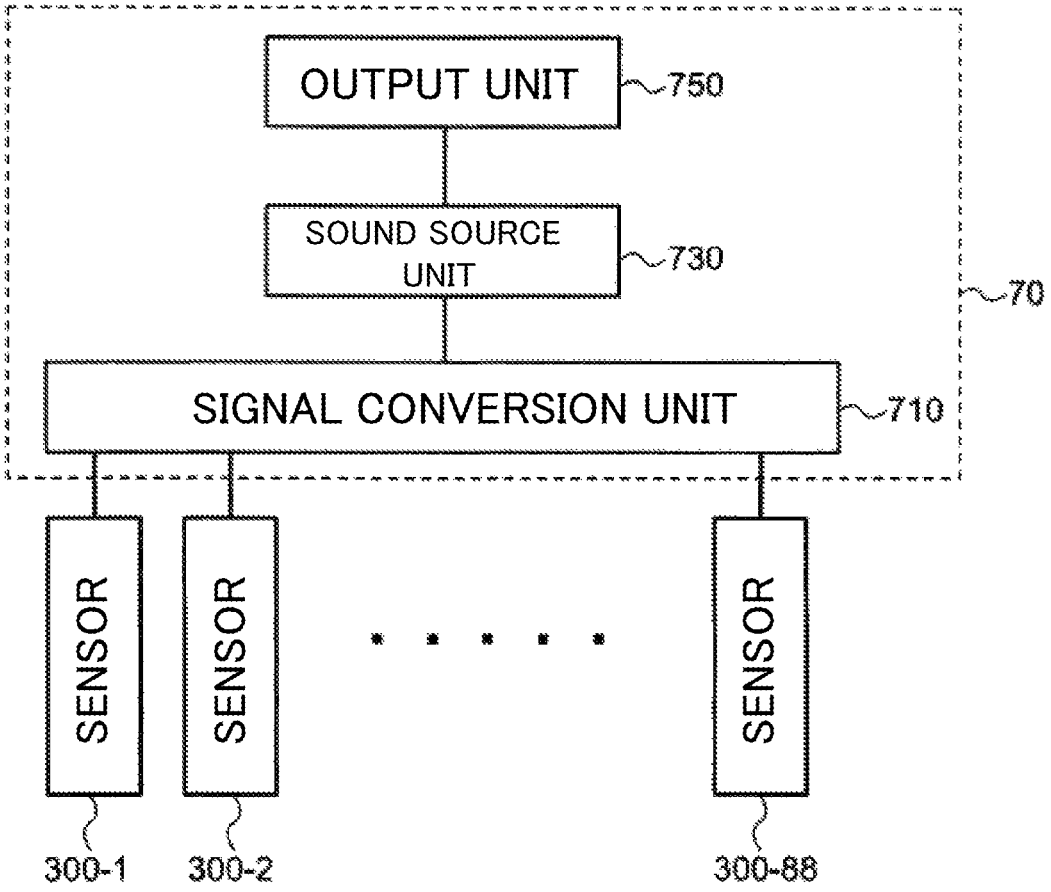
FIG. 2 is a block diagram that shows the configuration of a sound source device in the first embodiment.

FIG. 2 is a block diagram that shows the configuration of a sound source device in the first embodiment. The sound source device 70 includes a signal conversion unit 710, a sound source unit 730, and an output unit 750. A sensor 300 is provided corresponding to each key 100, detects operation of the corresponding key, and outputs a signal according to the detected content. In this example, the sensor 300 outputs a signal according to a three step key pressing amount. A key pressing speed can be detected according to an interval of this signal.

The signal conversion unit 710 obtains an output signal of the sensors 300 (sensors 300-1, 300-2, . . . , 300-88 corresponding to the 88 keys 100), generates an operation signal according to the operation state of each key 100, and outputs the operation signals. In this example, the operation signal is a signal in MIDI format. Therefore, according to the key pressing operation, the signal conversion unit 710 outputs a note-on signal. At this time, a key number indicating which of the 88 keys 100 was operated, and a velocity corresponding to the key pressing speed, are also output associated with the note-on signal. On the other hand, according to a key release operation, the signal conversion unit 710 outputs the key number and a note-off signal associated with each other. A signal corresponding to another operation such as operation of a pedal may also be input to the signal conversion unit 710, and reflected in an operation signal.

The sound source unit 730 generates a sound waveform signal based on the operation signal output from the signal conversion unit 710. The output unit 750 outputs the sound waveform signal generated by the sound source unit 730. The sound waveform signal is output to the speaker 80 or a sound waveform signal output terminal, for example. The configuration of the keyboard assembly 10 will be described below.

1-2. Configuration of Keyboard Assembly

Figure 3:
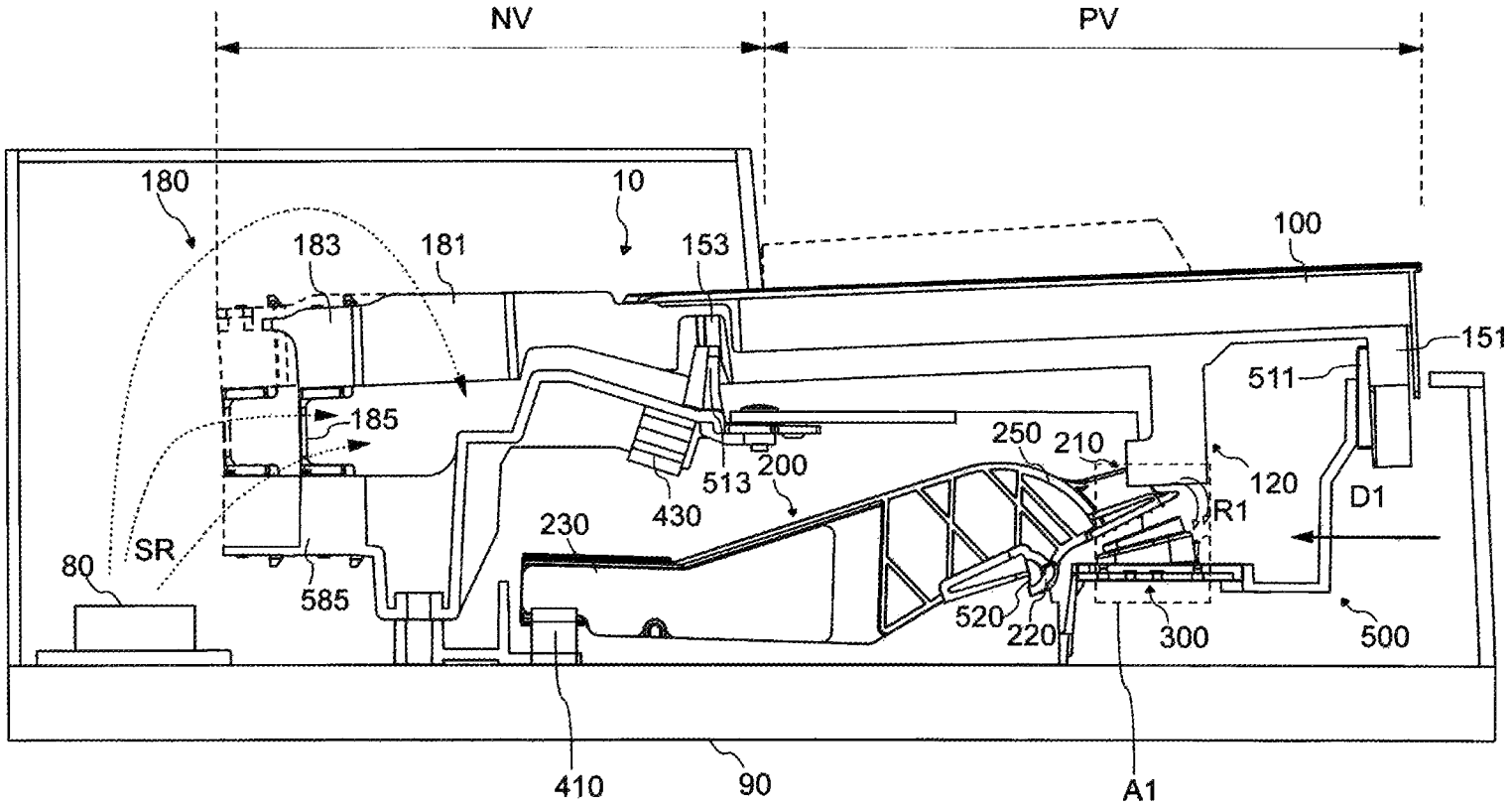
FIG. 3 is an explanatory view of the configuration inside a case in the first embodiment when viewed from a side face.

FIG. 3 is an explanatory view of the configuration inside the case in the first embodiment, viewed from the direction of a keyboard side face. As shown in FIG. 3, the keyboard assembly 10 and the speaker 80 are arranged inside the case 90. That is, the case 90 covers at least a portion (a connecting portion 180 and a frame 500) of the keyboard assembly 10 and the speaker 80. The speaker 80 is disposed at the rear side of the keyboard assembly 10. The speaker 80 is arranged so as to output a sound corresponding to key pressing toward the upper and lower sides of the case 90. The sound that is output downward travels from the lower face side of the case 90 to the outside. On the other hand, the sound that is output upward travels from the inside of the case 90 to pass through the space inside the keyboard assembly 10, and then travels from a gap between adjacent keys 100 in the visible portion PV or from a gap between the keys 100 and the case 90 to the outside. Note that a path of sound from the speaker 80 that reaches the space inside the keyboard assembly 10, that is, the space on the lower side of the key 100 (the key main body) is shown as a path SR, for example.

The keyboard assembly 10 includes the connecting portion 180, a hammer assembly 200, and the frame 500 in addition to the key 100 described above. The keyboard assembly 10 is a structure made of resin, mostly manufactured by injection molding or the like. The frame 500 is fixed to the case 90. The connecting portion 180 rotatably connects the key 100 to the frame 500. The connecting portion 180 includes a plate-like flexible member 181, a key side support portion 183, and a rod-like flexible member 185. The plate-like flexible member 181 extends from the rear end of the keys 100. The key side support portion 183 extends from the rear end of the plate-like flexible member 181. The rod-like flexible member 185 is supported by the key side support portion 183 and the frame side support portion 585 of the frame 500. That is, the rod-like flexible member 185 is arranged between the key 100 and the frame 500. Due to bending of the rod-like flexible member 185, the key 100 can rotate relative to the frame 500. The rod-like flexible member 185 is configured to be removable from the key side support portion 183 and the frame side support portion 585. Note that the rod-like flexible member 185 may be configured so as to not be removable, by being formed integrated with the key side support portion 183 and the frame side support portion 585, or by adhesion or the like.

The key 100 includes a front end key guide 151 and a side face key guide 153. The front end key guide 151 slidably contacts a front end frame guide 511 of the frame 500 in a state covering the front end frame guide 511. The front end key guide 151 is in contact with the upper and lower portions of the front end frame guide 511 on both sides in the scale direction. The side face key guide 153 slidably contacts a side face frame guide 513 on both sides in the scale direction. In this example, the side face key guide 153 is arranged in an area corresponding to the non-visible portion NV in the side face of the key 100, and exists on the key front end side relative to the connecting portion 180 (the plate-like flexible member 181), but the side face key guide 153 may also be arranged in an area corresponding to the visible portion PV.

Also, the key 100 is connected to a key side loading portion 120 below the visible portion PV. The key side loading portion 120 is connected to the hammer assembly (the hammer) 200 so as to allow the hammer assembly 200 to rotate when the key 100 rotates.

The hammer assembly 200 is arranged in a space below the key 100 and is rotatably attached to the frame 500. The hammer assembly 200 includes a weight portion 230 and a hammer body 250. The hammer main body 250 is provided with a shaft support portion 220 serving as a bearing for a rotational shaft 520 of the frame 500. The shaft support portion 220 and the rotational shaft 520 of the frame 500 slidably make contact at least three points.

A hammer side loading portion 210 is connected to a front end portion of the hammer main body 250. The hammer side loading portion 210 includes a portion that is slidable and contacts the inside of the key side loading portion 120 substantially in the front-rear direction. A lubricant such as grease may be arranged at this contact portion. The hammer side loading portion 210 and the key side loading portion 120 (in the following description, these may be collectively referred to as a "load generating portion") generate some of the load during key pressing by sliding against each other. The load generating portion is located below the key 100 in the visible portion PV (in front of the rear end of the key main body) in this example.

The weight portion 230 includes a metal weight, and is connected to the rear end portion (the rear side with respect to the rotational shaft) of the hammer main body 250. In a normal state (when the key is not pressed), the weight portion 230 is in a state loaded on a lower side stopper 410. Thus, the key 100 is stabilized in a rest position. When the key is pressed, the weight portion 230 moves upward and collides with an upper side stopper 430. This defines an end position, which is the maximum key pressing amount of the key 100. The weight 230 also applies a load to the key pressing. The lower side stopper 410 and the upper side stopper 430 are formed with a buffer material or the like (non-woven fabric, an elastic body, or the like).

The sensor 300 is attached to the frame 500 below the load generating portion. When the sensor 300 is pressed against on a lower face side of the hammer side loading portion 210 by key pressing, the sensor 300 outputs a detection signal. The configuration of the sensor 300 will be described in detail below.

1-3. Configuration of Sensor

Figure 4:
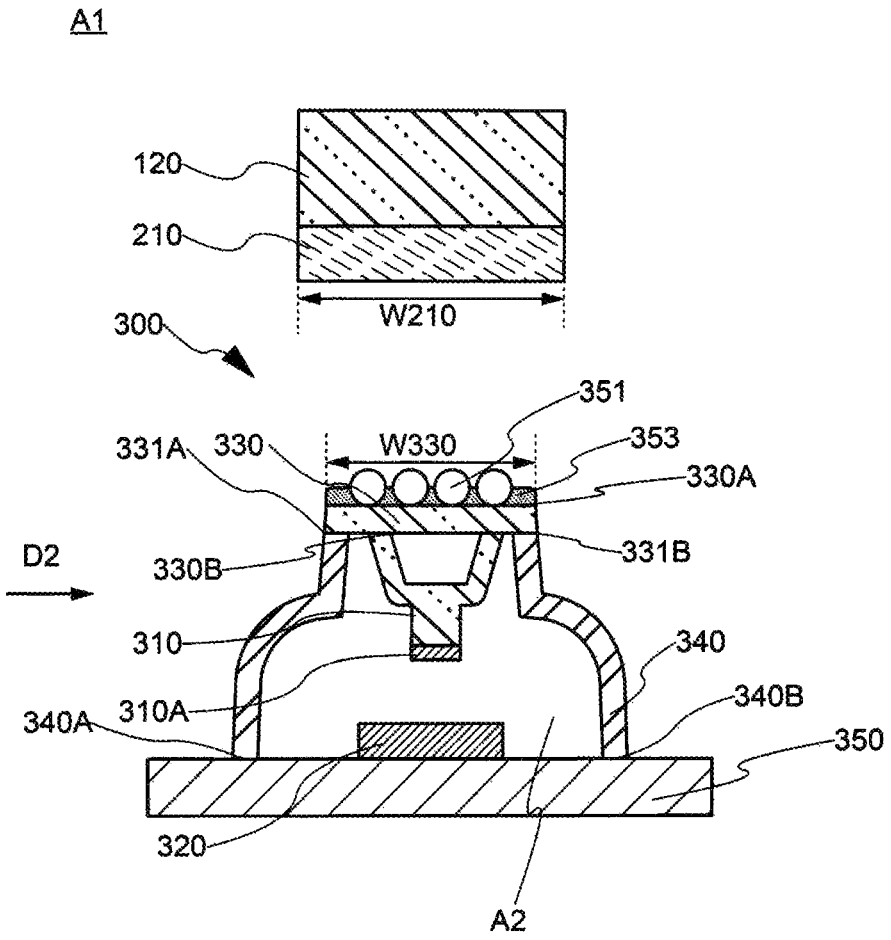
FIG. 4 is an explanatory view of a load generating portion and a sensor in the first embodiment when viewed from a key front end side.

FIG. 4 is a cross-sectional view in which an area A1 in FIG. 3 is viewed from the key front end side (the key front side), that is, viewed from a direction D1. The area A1 includes the hammer side loading portion 210, the key side loading portion 120, and the sensor 300.

The sensor 300 includes an upper electrode 310, a lower electrode 320, an upper electrode support portion 330, a deforming portion 340, and a lower electrode support portion 350.

The upper electrode 310 is provided on a lower face 330B of the upper electrode support portion 330. The upper electrode 310 is formed of an elastic body, and a conductive portion is provided in a tip portion 310A. In this example, molded silicone rubber is used in the upper electrode 310, and conductive carbon black is used as a conductor in the tip portion 310A.

The lower electrode 320 is arranged on an upper face side of the lower electrode support portion 350 so as to face the upper electrode 310. The lower electrode 320 includes a conductor. For example, a metal material such as gold, silver, copper, platinum or the like, or a conductive resin such as conductive carbon black is used in the lower electrode 320.

The deforming portion 340 is arranged so as to connect the upper electrode support portion 330 and the lower electrode support portion 350. The deforming portion 340 is connected to an end portion 331A and an end portion 331B at both ends in the left-right direction of the upper electrode support portion 330. Note that when the description does not particularly require them to be distinguished, the end portion 331A and the end portion 331B may be referred to as an end portion 331. Also, the deforming portion 340 may be fixed directly to the lower electrode support portion 350, or may be fixed indirectly. In this example, the deforming portion 340 is fixed to the lower electrode support portion 350 by a connecting portion 340A and a connecting portion 340B on both sides of the lower electrode 320. When the deforming portion 340 is fixed to another member, it does not need to be fixed to the lower electrode support portion 350. The deforming portion 340 has an elastic force such that it possible to hold the upper electrode 310 and the upper electrode support portion 330 so as to be movable in the vertical direction, and thus, the distance between the upper electrode 310 and the lower electrode 320 is allowed to be variable, and the deforming portion 340 can be restored to its original position. That is, when no external force is applied to the upper electrode support portion 330, the deforming portion 340 holds the upper electrode 310 and the lower electrode 320 so as to be spaced apart from each other, and when an external force is applied, the electrode 310 is moved downward together with the upper electrode support portion 330 to bring the upper electrode 310 and the lower electrode 320 into contact with each other. Therefore, a deformable and restorable member is used as the deforming portion 340. For example, molded silicone rubber is used in the deforming portion 340.

The upper electrode support portion 330 is arranged facing the hammer side loading portion 210. The width of the hammer side loading portion 210 is greater than the width of the upper electrode support portion 330 in the direction that the hammer side loading portion 210 moves relative to the upper electrode support portion 330. In this example, assuming that the hammer side loading unit 210 moves in a short axis direction (the scale direction, that is, a direction D2), a width W210 in the short axis direction (the scale direction, that is, the direction D2) of the hammer side loading portion 210 is greater than a width W330 in the short axis direction (the scale direction) of the upper electrode support portion 330. Note that the direction of movement of the hammer side loading portion 210 is not limited to the short axis direction, and may be a long axis direction of the key 100, or an oblique direction. Silicone rubber is used in the upper electrode support portion 330, such that the upper electrode support portion 330 can be processed and formed integrated with the upper electrode 310 and the deforming portion 340.

The lower electrode support portion 350 is provided as a separate member together with the lower electrode 320. For example, the lower electrode support portion 350 may be provided as a printed circuit board, and the lower electrode 320 may be an electrode formed on the printed circuit board. That is, the lower electrode 320 and the lower electrode support portion 350 can be collectively referred to as a circuit board.

In the above description, the upper electrode support portion 330, the lower electrode support portion 350, and the deforming portion 340 form an enclosed area A2. Here, it can be said that the upper electrode 310 and the lower electrode 320 are arranged in the area A2.

Particles 351 and a film 353 are provided between the upper electrode support portion 330 and the hammer side loading portion 210. In this example, the particles 351 and the film 353 holding the particles 351 are arranged on the upper face 330A side of the upper electrode support portion 330. The particles 351 and the film 353 have a function of enhancing lubrication when the hammer side loading portion 210 contacts the upper electrode support portion 330. In this example, spherical silica particles or the like are used as the particles 351. The particles 351 are not limited to a spherical shape, and may have a rod-like shape or an irregular shape. Further, the size of the particles 351 is not limited, but is appropriately set in a range of at least several hundred nm to not more than several hundred μm. Also, the hardness of the particles 351 is not limited. In addition, the particles 351 may be coated with a lubricant. The film 353 includes oil. The film 353 may also include a lubricant such as grease. Also, the film 353 may have elasticity.

Figure 5:
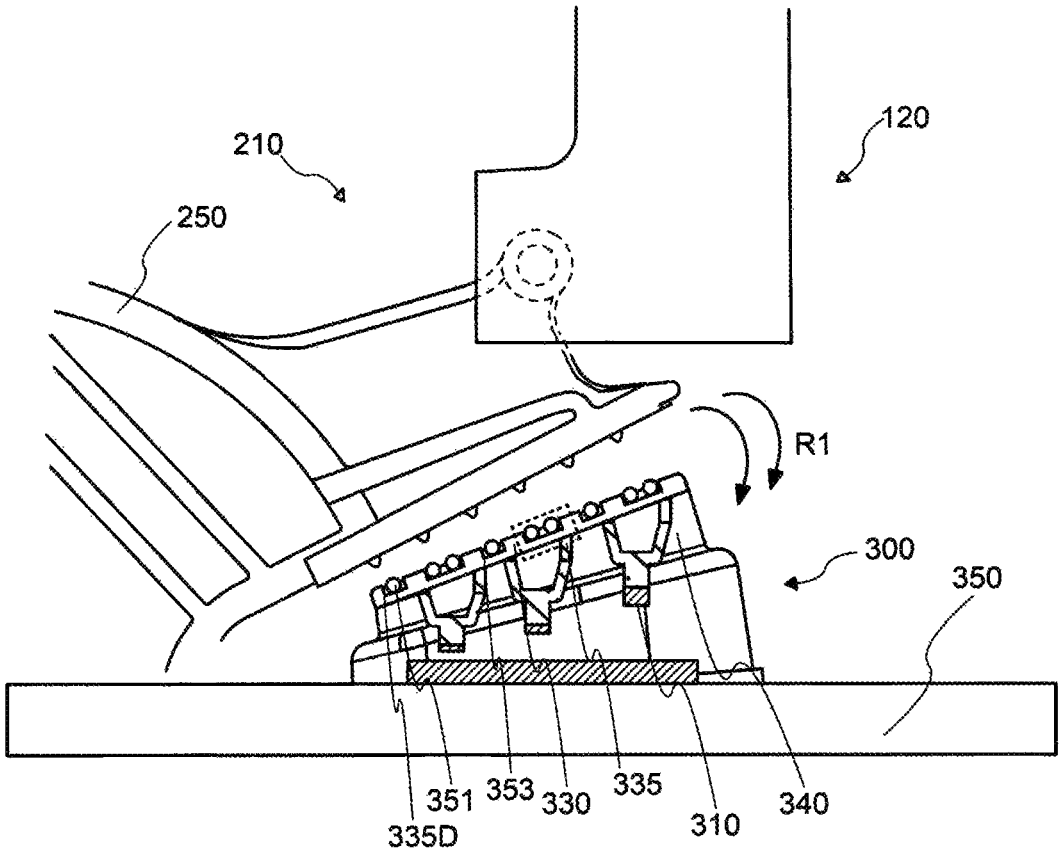
FIG. 5 is an explanatory view of the load generating portion and the sensor in the first embodiment when viewed from a keyboard side face.

FIG. 5 is a cross-sectional view in which the area A1 in FIG. 3 as viewed from the lateral direction (the keyboard scale direction, that is, the direction D2 in FIG. 4) of the keyboard. As shown in FIG. 5, the upper electrode support portion 330 of the sensor 300 is arranged relative to the lower electrode support portion 350, corresponding to a trajectory R1 where the hammer side loading portion 210 rotates. In this example, the upper electrode support portion 330 is arranged inclined relative to the lower electrode support portion 350. Note that this is not a limitation, and the upper electrode support portion 330 also may be arranged parallel, depending on the position where the lower electrode support portion 350 is arranged. Here, the upper electrode support portion 330 may include a plurality of recessed portions 335. The recessed portions 335 may be larger than the diameter of the particles 351, and may be large enough to accommodate a plurality of particles. By adopting such a configuration, the particles 351 are prevented from flowing from the upper electrode support portion 330 and disappearing, and further, the particles 351 are held so as to roll within the recessed portions 335. Also, the recessed portions 335 have a depth 335D that allows a portion of the particles 351 to be exposed. Thus, a function of improving lubrication provided by the particles 351 can be exhibited.

The film 353 is provided to facilitate dispersion of the particles 351 on the upper electrode support portion 330 and to improve lubrication. The film 353 may have fluidity so as not to restrict the movement of the particles 351. For example, the particles 351 may be held so as to roll in the film 353. The film 353 may be removed after the particles 351 are dispersed on the upper electrode support portion 330. Also, the film 353 may include a volatile liquid, for example. In this case, a fluorine-based solvent is used in the film 353.

1-4. Operation of Keyboard Assembly

Figure 6A:
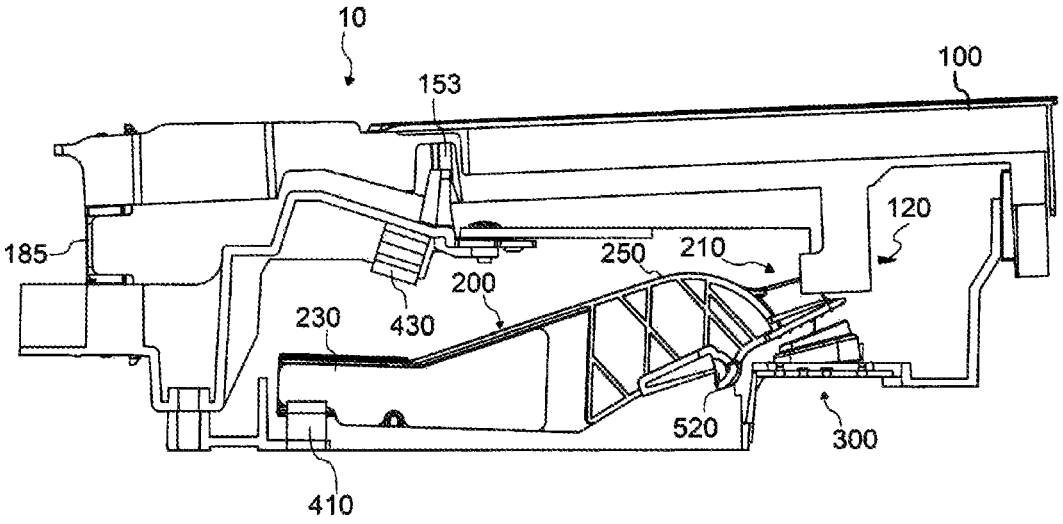
FIG. 6A illustrates operation of a key assembly when a key (a white key) is pressed in the first embodiment.
Figure 6B:
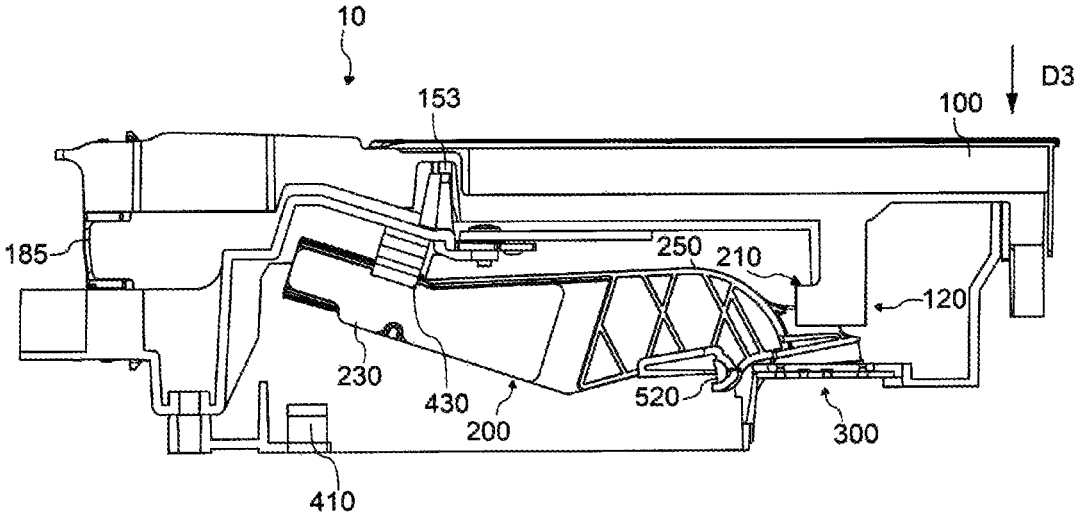
FIG. 6B illustrates operation of a key assembly when a key (a white key) is pressed in the first embodiment.

FIGS. 6A and 6B illustrates operation of a key assembly when a key (a white key) is pressed. FIG. 6A shows a case where the key 100 is in the rest position (in a state where the key is not pressed). FIG. 6B shows a case where the key 100 is in the end position (in a state where the key is pressed all the way to the end). When the key 100 is pressed, the rod-like flexible member 185 bends as the center of rotation. At this time, the rod-like flexible member 185 is bent and deformed in the forward direction (front direction) of the key 100, but due to restriction of movement in the front-rear direction by the side face key guide 153, the key 100 rotates in a direction D3 rather than moving forward. Then, when the key side loading portion 120 pushes down the hammer side loading portion 210, the hammer assembly 200 rotates around the rotational shaft 520. Note that in the description of FIG. 6, reference is made to FIGS. 4 and 5 regarding the respective portions of the sensor 300.

Collision of the weight portion 230 with the upper side stopper 430 stops the rotation of the hammer assembly 200, and the key 100 reaches the end position. In addition, when the sensor 300 is pressed against by the hammer side loading portion 210, the sensor 300 outputs a detection signal at a plurality of steps corresponding to the amount of pressing (the key pressing amount). In this case, the hammer side loading portion 210 functions as one actuator. That is, the hammer functions as an actuator. Note that a cross-sectional view of the sensor 300 when viewed from the key tip direction at this time is shown in FIG. 7.

Figure 7:
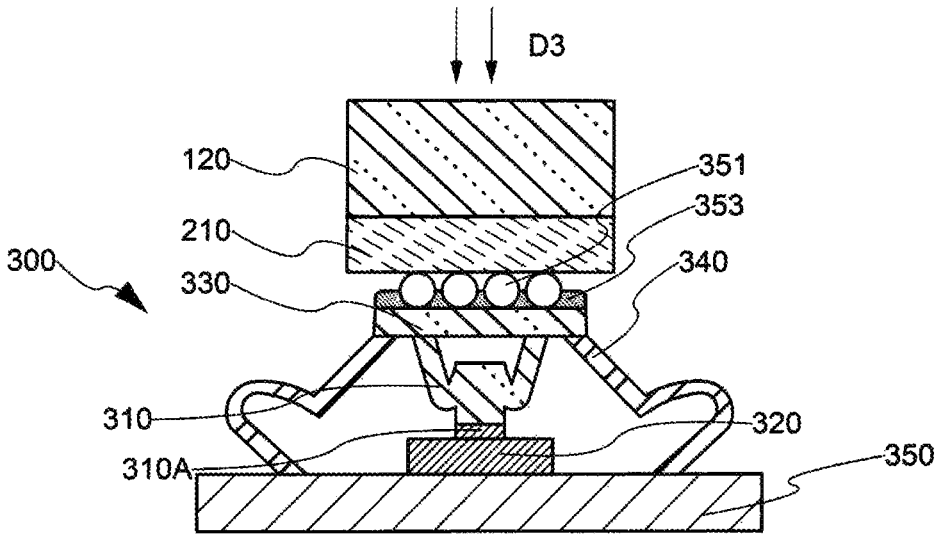
FIG. 7 is an explanatory view of the sensor when pressed by the load generating portion in the first embodiment.
Figure 11:
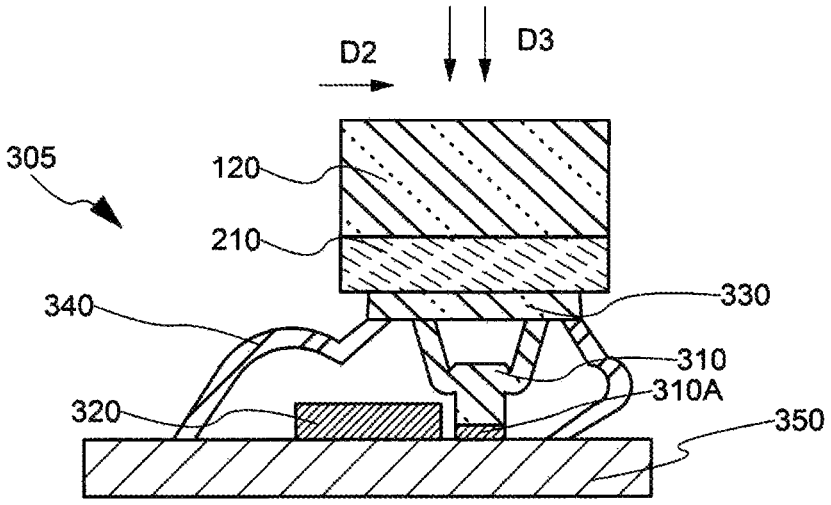
FIG. 11 is an explanatory view of a sensor when pressed by a load generating portion in a conventional example.

As shown in FIG. 7, in the sensor 300, when the upper electrode support portion 330 is pressed in the vertical direction (the direction D3) relative to the lower electrode support portion 350 by the hammer side loading portion 210, the upper electrode 310 and the lower electrode 320 contact each other. However, there are cases where force is also applied to the hammer side loading portion 210 in the scale direction (the direction D2), for example. FIG. 11 shows a cross-sectional view when force is applied in the scale direction (the direction D2) in a conventional example. As shown in FIG. 11, in the conventional example, when force is applied in the scale direction (D2) after the hammer side loading portion 210 contacts the upper electrode support portion 330, the hammer side loading portion 210 is pressed in a direction offset from the vertical direction (the direction D3). In this case, if the hammer side loading portion 210 and the upper electrode support portion 330 stick together (adhere), and the friction between the hammer side loading portion 210 and the upper electrode support portion 330 is large, movement of the upper electrode support portion 330 follows the movement of the hammer side loading portion 210. Furthermore, the deforming portion 340 connected to the upper electrode support portion 330 is also deformed according to the upper electrode support portion 330. In this case, as shown in FIG. 11, the upper electrode 310 cannot be electrically connected to the lower electrode 320. When the upper electrode 310 and the lower electrode 320 cannot be electrically connected, the sensor 305 cannot output a detection signal, so the keyboard device 1 cannot generate sound. Also, even if the upper electrode 310 and the lower electrode 320 are partially connected, the connection is not stable, so the keyboard device 1 cannot stably generate sound.

Figure 8:
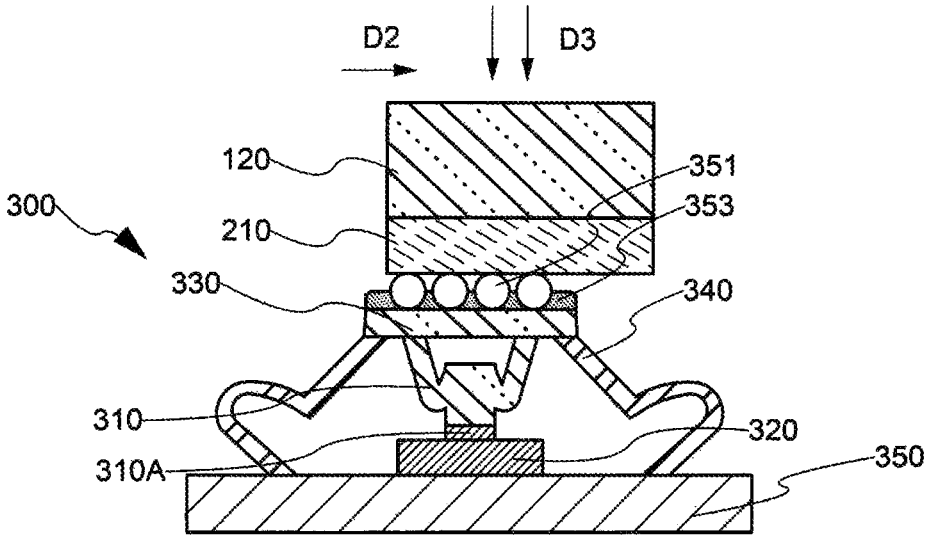
FIG. 8 is an explanatory view of the sensor when pressed by the load generating portion in the first embodiment.

FIG. 8 is a cross-sectional view, using the present embodiment, viewed from the key tip direction of the sensor 300 when the upper electrode support portion 330 is pressed by the hammer side loading portion 210. By using the present embodiment, the hammer side loading portion 210 and the upper electrode support portion 330 do not contact each other, but rather, the hammer side loading portion 210 and the particles 351 contact each other. The particles 351 exist in a state movable in the scale direction (the direction D2). In addition, the particles 351 are harder than the hammer side loading portion 210, and have a spherical shape, so their shape is maintained even when pressed by the hammer side loading portion 210. Here, rolling friction acts due to rolling of the particles 351, not static friction. Frictional force is less with rolling friction than with static friction. Therefore, the upper electrode support portion 330 does not follow shifting of the hammer side loading portion 210 in the scale direction (D2), so the upper electrode support portion 330 has less of an effect on movement of the hammer side loading portion 210 in the scale direction (D2), and therefore it is possible to maintain a predetermined position for the upper electrode 310 arranged in the upper electrode support portion 330. Thus, as shown in FIG. 8, when the upper electrode support portion 330 is pressed by the hammer side loading portion 210, the upper electrode 310 and the lower electrode 320 can reliably make contact with each other.

Second Embodiment

2. Configuration of Sensor 300*a*

In the second embodiment, a sensor having a structure different from that in the first embodiment will be described.

Figure 9:
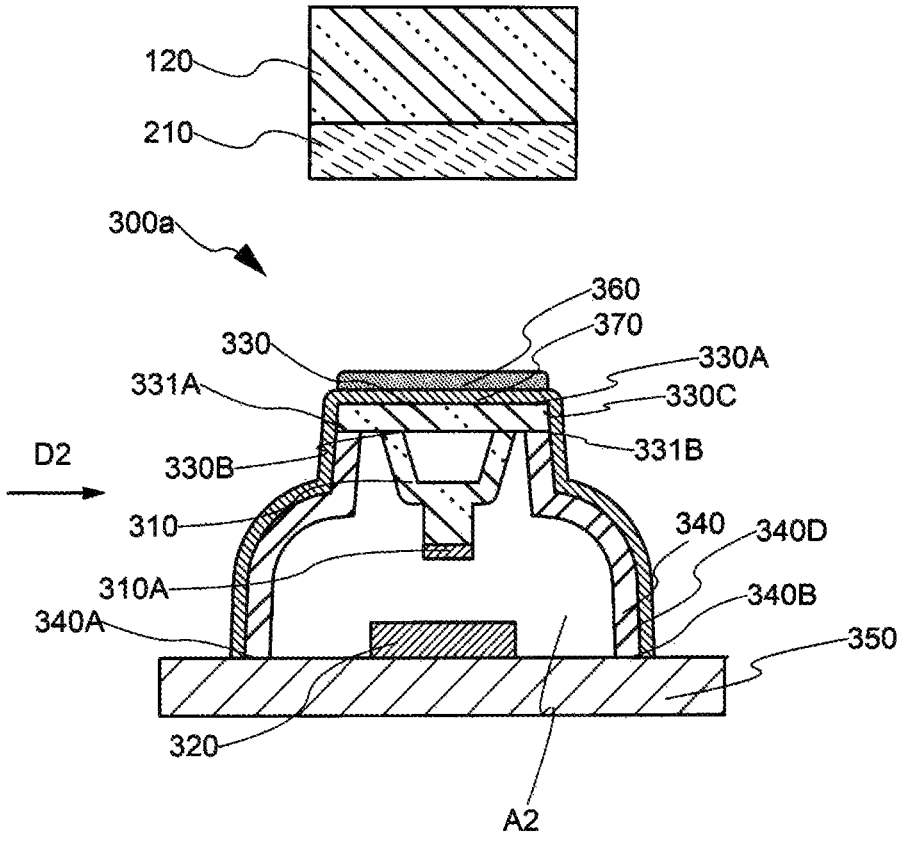
FIG. 9 is an explanatory view of a load generating portion and a sensor in a second embodiment.

FIG. 9 shows a cross-sectional view of a sensor 300*a*. As shown in FIG. 9, a fluid lubricant 360 and a permeation inhibitor 370 are provided on the upper electrode support portion 330. The fluid lubricant 360 has a function of allowing the hammer side loading portion 210 to move smoothly. A material having fluidity such as grease or lubricating oil is used for the fluid lubricant 360.

When lubricating oil or grease is used for the fluid lubricant 360, an oil film can be formed between the hammer side loading portion 210 and the upper electrode support portion 330, resulting in a fluid lubrication state. As a result, adhesion between faces is prevented, and the coefficient of friction is greatly reduced.

The permeation inhibitor 370 is provided between the fluid lubricant 360 and the upper electrode support portion 330, and at a side face 330C of the upper electrode support portion 330 and a side face 340D of the deforming portion 340. Note that the permeation inhibitor 370 may be provided only on the upper face 330A of the upper electrode support portion 330, according to the arrangement of the fluid lubricant 360. The permeation inhibitor 370 has a function of preventing the oil in the fluid lubricant 360 from penetrating inside the upper electrode 310 or the deforming portion 340. For the permeation inhibitor 370, for example, a silicon-based resin or a fluorine-based resin is used. The permeation inhibitor 370 is formed by coating, but a film may also be attached using an adhesive. Alternatively, the permeation inhibitor 370 may be included inside of the upper electrode support portion 330 and the deforming portion 340.

By providing the permeation inhibitor 370, oil does not adhere to the upper electrode 310, and contact and separation between the upper electrode 310 and the lower electrode 320 can be performed smoothly. Thus, detection defects in the sensor 300*a* are prevented.

Consequently, friction between the upper electrode support portion 330 and the hammer side loading portion 210 is reduced by the fluid lubricant 360 and permeation inhibitor 370, and therefore the sensor 300*b* can stably output the detection signal. Consequently, the keyboard device 1 can stably generate sound. Note that this sort of permeation inhibitor 370 can also be used in the first embodiment or in the second embodiment described next.

Third Embodiment

3. Configuration of Sensor 300*b*

In the third embodiment, a case of using a solid lubricant in a sensor 300*b* will be described.

Figure 10:
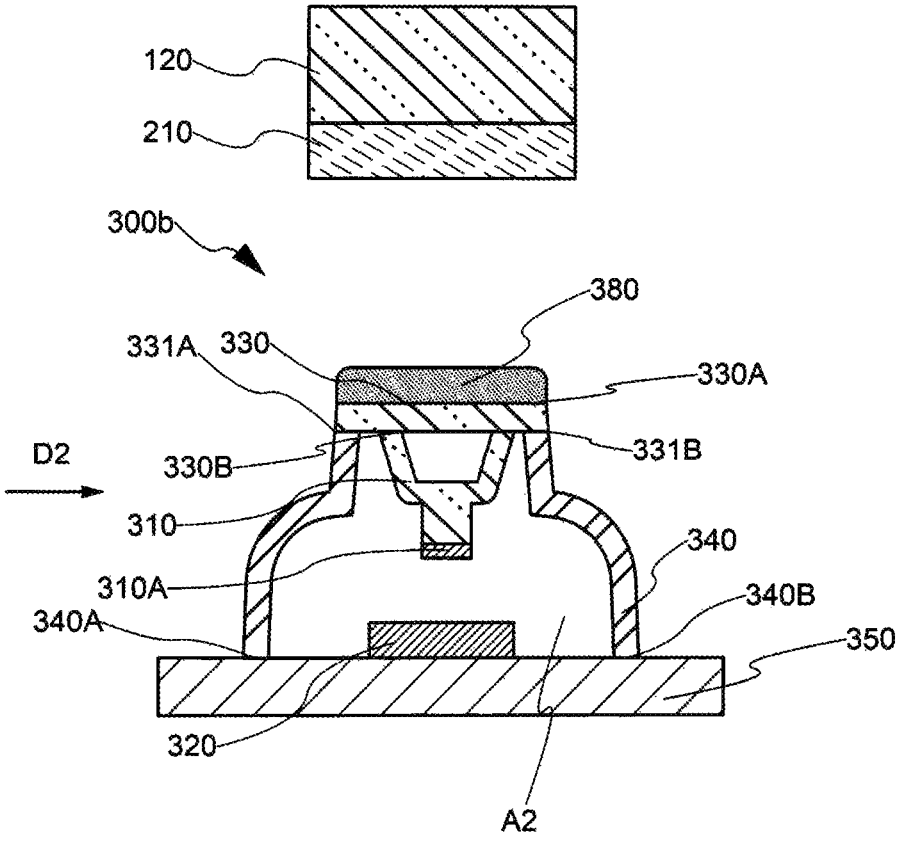
FIG. 10 is an explanatory view of a load generating portion and a sensor in a third embodiment.

FIG. 10 shows a cross-sectional view of a sensor 300*b*. As shown in FIG. 10, a solid lubricant 380 is provided on the upper electrode support portion 330. The solid lubricant 380 may be formed by coating or may be attached as a film through an adhesive. The solid lubricant 380 has low surface energy and small intermolecular force with an object it contacts. When a solid lubricant is used as the solid lubricant 380, specifically, polyethylene tetrafluoroethylene (PTFE), graphite (graphite), molybdenum disulfide, silver, lead or the like is used. For example, when polyethylene tetrafluoroethylene is used as the solid lubricant, the hammer side loading portion 210 and the solid lubricant 380 do not adhere to each other because the intermolecular force on the surface is small. Therefore, the frictional force is reduced. Also, when a layered crystal structure material such as molybdenum disulfide is used as the solid lubricant 380, slippage occurs layer by layer against an applied force. As a result, the frictional force is reduced. The solid lubricant 380 is chemically stable, and therefore its effects can be stably exhibited in an environment where the keyboard device 1 is played.

VARIATIONS

Although embodiments of the present invention were described above, this invention can also be implemented in various modes, such as those described below.

In the first to third embodiments of the present invention, an example was described in which the hammer side loading portion 210 makes contact, but a configuration may also be adopted in which the key side loading portion 120 directly contacts the upper electrode support portion 330, and may be pressed. That is, the key 100 may also function as an actuator. In this case, the arrangement of the sensor 300 is different from the position shown in FIG. 3, and the sensor 300 is arranged immediately below the key 100 (for example, in FIG. 3, at an intermediate position of a line joining the front end key guide 151 and the side face key guide 153). In this case, the key 100 is connected to the hammer assembly 200 at a position different from the position shown in FIG. 3. The key side loading portion 120 is directly affected by the player's key pressing, so the upper electrode support portion 330 is more easily shifted in the scale direction. Therefore, the effects of using the present invention can be further obtained.

The shape of the deforming portion 340 is not limited to the shape disclosed in the above embodiments. That is, the deforming portion 340 may also have a shape such that, when the upper electrode support portion 330 is not pressed by the actuator, the upper electrode 310 and the lower electrode 320 are held such that they are arranged with a gap between them, and when the upper electrode support portion 330 is pressed by the actuator, the deforming portion 340 moves the upper electrode 310 downward together with the upper electrode support portion 330, such that the upper electrode 310 and the lower electrode 320 can contact each other.

Also, in each embodiment of the present invention, an example was described in which the upper electrode support portion is shifted in the scale direction, but the present invention is also applicable when the upper electrode support portion is shifted in a direction perpendicular to the scale direction or in an oblique direction.

In each of the embodiments of the present invention, an example was described in which the particles 351, the fluid lubricant 360 and the solid lubricant 380 are provided on the upper electrode support portion 330 side, but these may be provided on the hammer side loading portion 210 side.

Figure 12:
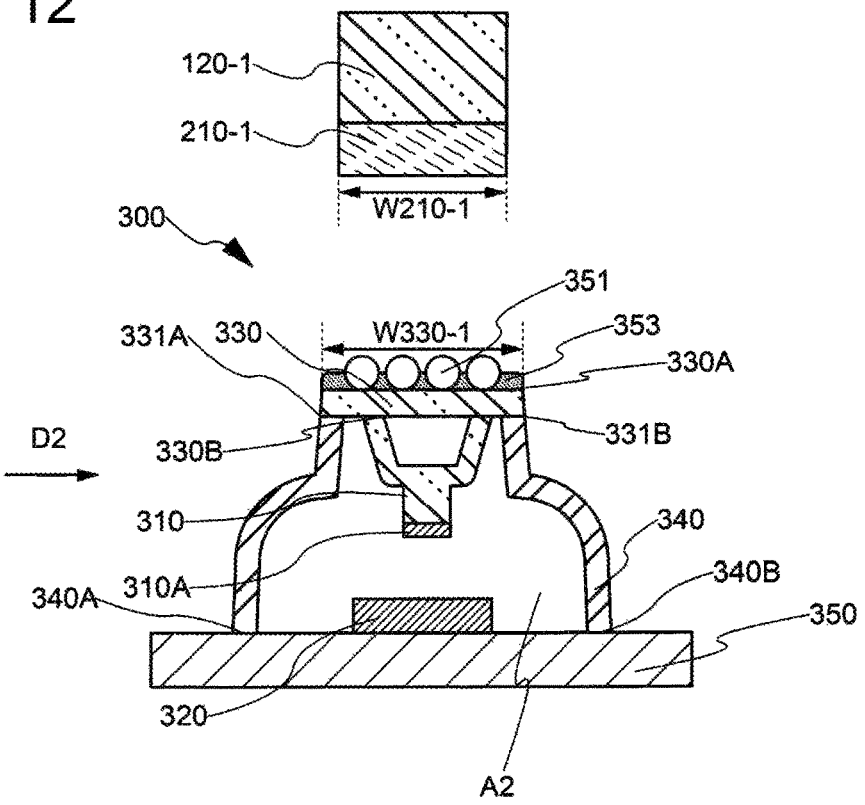
FIG. 12 is an explanatory view of a variation of the load generating portion and the sensor in the first embodiment when viewed from the keyboard side face.

In each of the embodiments of the present invention, a case was described in which the width of the hammer side loading portion 210 is greater than the width of the upper electrode support portion 330 in the direction that the hammer side loading portion 210 moves relative to the upper electrode support portion 330, but this is not a limitation. The width of the hammer side loading portion 210 may be equal to or may be less than the width of the upper electrode support portion 330 in the direction that the hammer side loading portion 210 moves relative to the upper electrode support portion 330. For example, as shown in FIG. 12, assuming that the hammer side loading unit 210 moves in a short axis direction (the scale direction, that is, the direction D2), a width W210-1 in the short axis direction (the scale direction, that is, the direction D2) of the hammer side loading portion 210 may be less than a width W330-1 in the short axis direction (the scale direction) of the upper electrode support portion 330. In the above-described case, the hammer side loading portion 210 easily shifts in the scale direction (D2). However, by using one embodiment of the present invention, the upper electrode support portion 330 does not follow that shift, so the upper electrode support portion 330 has less of an effect on movement of the hammer side loading portion 210 in the scale direction (D2), and therefore it is possible to maintain a predetermined position for the upper electrode 310 arranged in the upper electrode support portion 330. Thus, even if the width W210 in the short axis direction of the hammer side loading portion 210 is less than the width W330 in the short axis direction of the upper electrode support portion 330, when the upper electrode support portion 330 is pressed by the hammer side loading portion 210, the upper electrode 310 and the lower electrode 320 can reliably make contact with each other.

Figure 13:
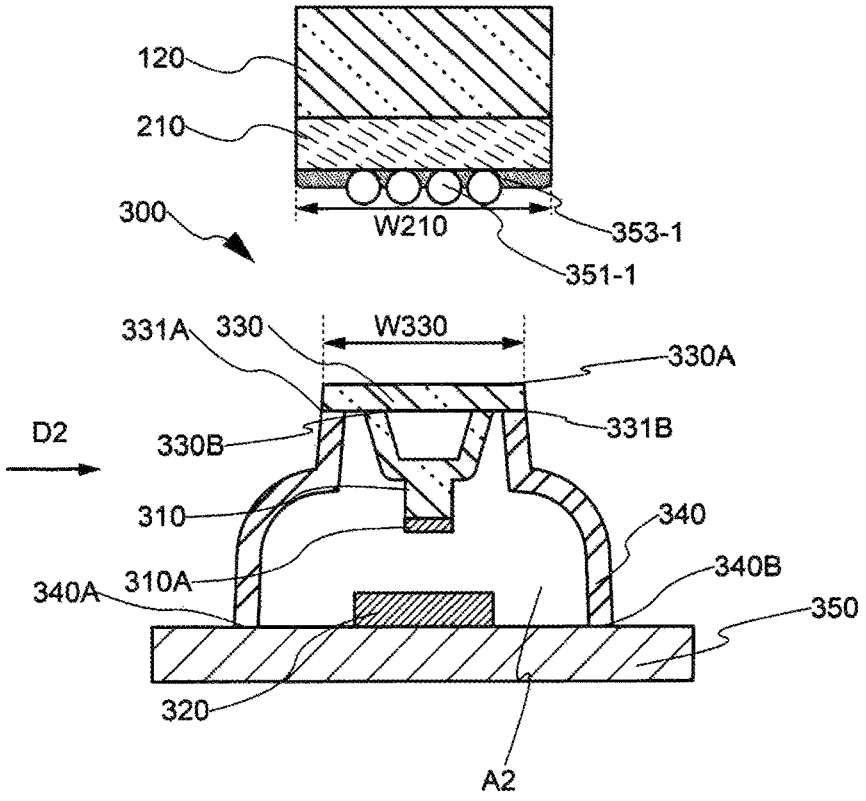
FIG. 13 is an explanatory view of a variation of the load generating portion and the sensor in the first embodiment when viewed from the keyboard side face.

In each of the embodiments of the present invention, an example was described in which the particles 351 and the film 353 are arranged on the upper face 330A side of the upper electrode support portion 330, but this is not a limitation. As shown in FIG. 13, particles 351-1 and a film 353-1 may be arranged on the surface of the hammer side loading portion 210.

Also, it is not necessary for the hammer side loading portion 210 and the key side loading portion 120 to press the upper electrode support portion 330. For example, another member separated from the hammer side loading portion 210 or the key side loading portion 120 may function as an actuator. In this case, the actuator may be a movable member that operates together with a key or a hammer.

The invention claimed is:

1. A sensor comprising:

an upper electrode;

a lower electrode facing the upper electrode;

an upper electrode support portion provided in an upper portion of the upper electrode;

a deforming portion supporting the upper electrode support portion and configured to change a distance between the upper electrode and the lower electrode;

an actuator arranged facing the upper electrode support portion; and a movable member, including a film holding particles, arranged between the upper electrode support portion and the actuator, and configured to move relative to at least one of the actuator or the upper electrode support portion upon the actuator pressing the upper electrode support portion.

2. The sensor according to claim 1, further comprising:

a lower electrode support portion, wherein the lower electrode is arranged on the lower electrode support portion, and wherein the upper electrode and the lower electrode are arranged within an area enclosed by the lower electrode support portion, the upper electrode support portion, and the deforming portion.

3. The sensor according to claim 1, wherein the movable member is arranged in the upper electrode support portion.

4. The sensor according to claim 1, wherein at least one of the upper electrode support portion or the actuator includes at least one recessed portion larger than the diameter of the particles, and at least part of the particles is exposed from the recessed portion.

5. The sensor according to claim 1, wherein the movable member includes a lubricant.

6. The sensor according to claim 5, wherein:

the upper electrode support portion includes a permeation inhibitor of the lubricant disposed at, at least one of inside or an upper face of the upper electrode support portion, and the deforming portion includes the permeation inhibitor disposed at, at least one of inside or a side face of the deforming portion.

7. The sensor according to claim 1, wherein a width of the actuator is greater than a width of the upper electrode support portion in a direction where the actuator moves relative to the upper electrode support portion.

8. The sensor according to claim 1, wherein the width of the actuator is equal to or less than the width of the upper electrode support portion in the direction where the actuator moves relative to the upper electrode support portion.

9. A keyboard device comprising:

a key;

a hammer that rotates according to a movement of the key; and a sensor comprising:

an upper electrode;

a lower electrode facing the upper electrode;

an upper electrode support portion provided in an upper portion of the upper electrode;

a deforming portion supporting the upper electrode support portion and configured to change a distance between the upper electrode and the lower electrode;

an actuator arranged facing the upper electrode support portion; and a movable member, including a film holding particles, arranged between the upper electrode support portion and the actuator, and configured to move relative to at least one of the actuator or the upper electrode support portion upon the actuator pressing the upper electrode support portion.

10. The keyboard device according to claim 9, wherein the actuator is the key.

11. The keyboard device according to claim 9, wherein the actuator is the hammer.

12. The keyboard device according to claim 9, wherein the actuator comprises another movable member that operates together with the key or the hammer.

* * * * *